United States Patent [19]

Elliott

[11] 4,006,819

[45] Feb. 8, 1977

[54] SAFETY MATCHBOOK HAVING INTERLOCKING COVER PANELS

[76] Inventor: Benjamin P. Elliott, 11000 Dobbins Drive, Potomac, Md. 20854

[22] Filed: May 14, 1975

[21] Appl. No.: 577,161

[52] U.S. Cl. ..... 206/104; 206/1.5; 206/112

[51] Int. Cl.[2] ..... A24F 27/00

[58] Field of Search ..... 206/1.5, 92–93, 206/104, 106, 112, 491; 229/44 R, 45, 77

[56] References Cited

UNITED STATES PATENTS

| | | | |
|---|---|---|---|
| 2,151,116 | 3/1939 | Jones | 206/112 |
| 2,350,144 | 5/1944 | Barros | 206/112 |
| 2,526,833 | 10/1950 | Sweeney | 206/104 |

*Primary Examiner*—Steven E. Lipman

[57] ABSTRACT

A matchbook folder having a safety interlock between the lid and the base; the base portion of the folder has a double-fold end and the lid portion has a single-fold end which interlock with each other to prevent opening the folder except by a lateral sliding action of the lid relative to the base and permitting closing of the folder by a longitudinal downward movement of the lid relative to the base.

4 Claims, 4 Drawing Figures

SAFETY MATCHBOOK HAVING INTERLOCKING COVER PANELS

BACKGROUND OF THE INVENTION

This invention relates to a safety matchbook having a design which makes it difficult for the folder or cover to be opened accidentally, particularly by small children. More particularly, the invention provides an interlock between the matchbook cover and the base of the matchbook to prevent the cover from being opened merely by pulling the lid in the normal manner.

The most relevant prior art methods of "locking" a match package appear to include the following:

U.S. Pat. No. 2,116,231 to Beyer has a cover with a lock flap, the edge of which is turned outwardly. When the flap is inserted into an entrance throat under the edge of the striking lid, it moves the flap or striking lid into striking position; U.S. Pat. No. 1,851,042 to Freedman uses a spring element against a strip which in turn exerts pressure on the cover flap when it is inserted under the strip, otherwise this is strictly a pressure device lock; U.S. Pat. No. 2,311,794 to Warner shows a match packet having a cover flap with a recess cut into it and with tapering sides leading to two notches. When the flap is inserted behind the striking surface, the notch lockingly engages with two legs and the staple holding the matches to the book. U.S. Pat. No. 2,763,368 to Malek shows a metallic latch which, when pushed to its uppermost position, prevents the cover from being easily opened to make the matches available; U.S. Pat. No. 2,475,523 to Russo is still another way of locking a matchbook cover in that there are actually two covers with inwardly curved ends over the heads of the matches and which snap together in closing the match case.

SUMMARY OF THE INVENTION

The safety feature upon which this invention is based constitutes an interlock provided between the lid and the base. The interlock can be of any material having sufficient stiffness to minimize forcing open the lid by pulling it in the normal manner.

In order to open the cover, the cover is pushed down towards the base and slipped to one side or the other. This action will slide the interlock to the point where it is no longer engaged, thus allowing the cover to be opened. When the user has finished using the matchbook, the cover is pushed back into the base in the normal manner where it will interlock automatically.

DESCRIPTION OF THE PREFERRED EMBODIMENTS

Figure 1:
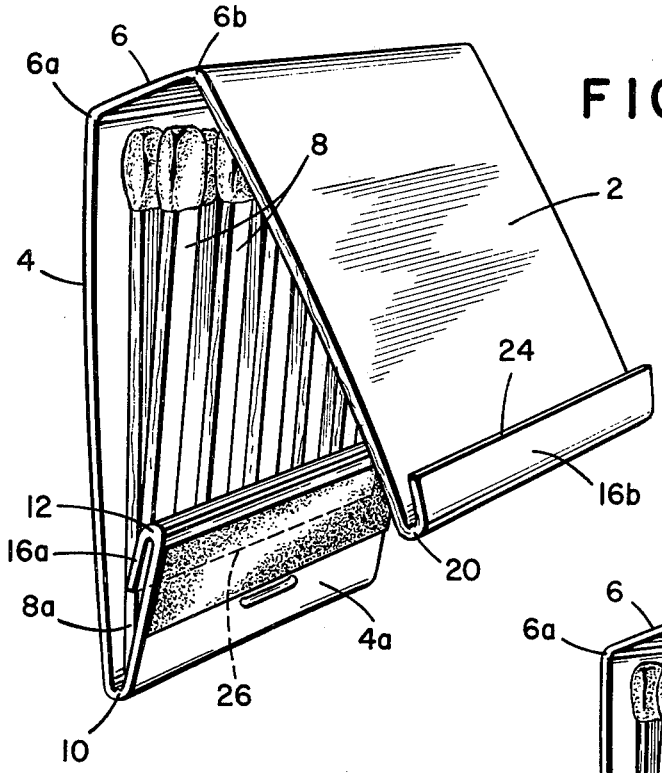
FIG. 1 shows a first embodiment of the safety matchbook cover with interlock according to this invention.

FIG. 1 shows a first embodiment of the safety matchbook cover of this invention. The cover is formed of a single strip of material such as cardstock, or the like, having sufficient stiffness to maintain its shape and yet having sufficient flexibility to permit easy bending and skewing movements of the various parts of the cover. The cover itself consists of a face panel 2 and a back panel 4 formed by folding over the strip along fold lines 6*a* and 6*b*, thereby spacing apart the panels a distance sufficient to accommodate matches 8. The folds 6*a* and 6*b* should be so located that top panel 6 will be spaced sufficiently above the tops of the matches to permit the face panel 2 to be depressed to the point where the interlock, to be described in detail below, can be engaged or disengaged.

The matches are formed in the usual manner to be provided with a base portion 8*a*. The panel 4 is folded outwardly and upwardly at 10 around base portion 8*a* and secured thereto by a staple, or other known securing means, in the usual manner.

The upwardly folded-over portion 4*a* of the back panel 4 is folded again along line 12 downward and inward to form the downward-facing half of the matchbook interlock, designated by reference numeral 16*a*. The free end of face panel 2 is folded outwardly along line 20 to form the upward-facing half 16*b* of the matchbook interlock.

Figure 1A:
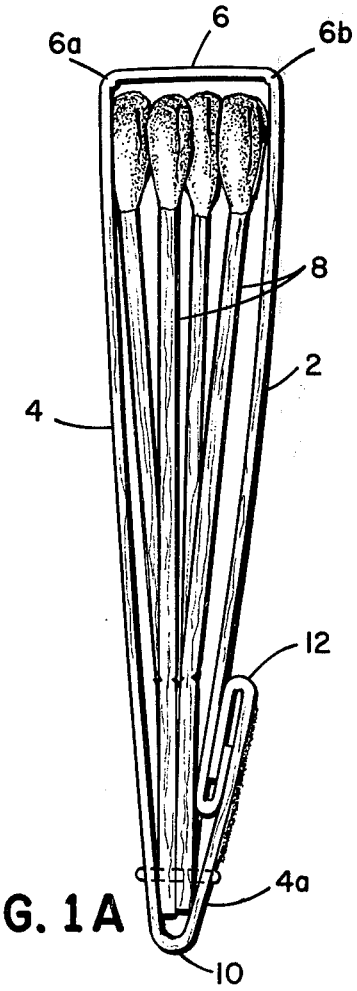
FIG. 1A shows a side view of the first embodiment.

To lock the cover closed, the face panel 2 of the matchbook cover is pushed longitudinally downwardly so that interlock half 16*b* slides against half 16*a* until the edge 24 of interlock half 16*b* moves past edge 26 of interlock half 16*a*. The inherent resiliency of the faces 16*a* and 16*b* will then cause them to spring outwardly and interlock with each other as shown in FIG. 1A. This prevents the cover from being opened by pulling upwardly on face panel 2 in the longitudinal direction.

The two interlocked parts of the matchbook cover can be disengaged by sliding the face panel 2 downward and laterally outward toward either the right or left side of the matchbook until the two parts 16*a* and 16*b* no longer overlap.

Figure 2:
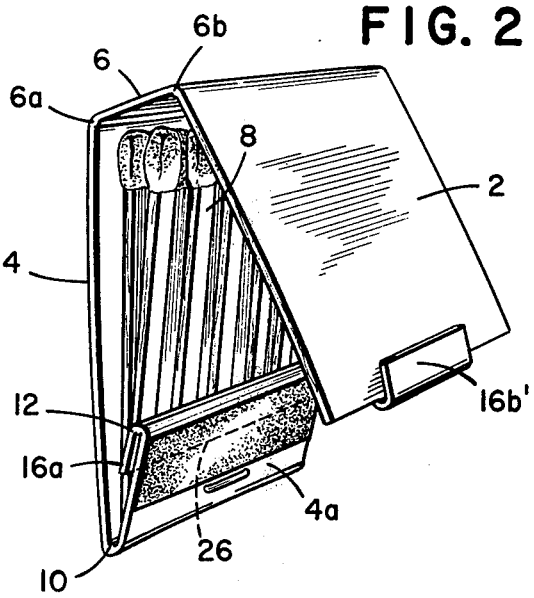
FIGS. 2 and 3 show second and third embodiments, respectively, of the invention.

FIG. 2 shows a modified form of the invention in which the single-fold part of the interlock constitutes a tab 16*b*'. The width of this tab is less than the width of face panel 2. The use of a tab requires less lateral movement to unlock the cover than is the case with the embodiment of FIG. 1. In all other essential respects, the two embodiments are similar.

Figure 3:
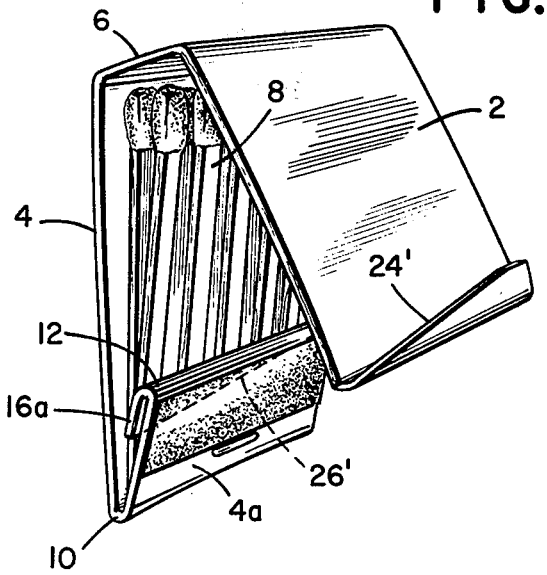

A further modification is shown in FIG. 3 where the single-fold portion 16*b* has a bevelled edge 24' and the doublefold interlock half 16*a* has a complementary bevelled edge 26'. These complementary bevelled or sloping edges are provided to permit unlocking the matchbook with less lateral movement than is required of either the embodiments of FIGS. 1 or 2, while at the same time retaining the interlocked capability of the cover to prevent opening the cover by pulling the face panel 2 only in the longitudinal direction, that is, upwardly away from the doublefolded portion 4*a*.

It is to be understood that various modifications in the structural details of the preferred embodiment described herein may be made within the scope of this invention and without departing from the spirit thereof. It is intended that the scope of this invention shall be limited solely by the hereafter appended claims.

What is claimed is:

1. A matchbook folder with safety interlock, comprising: a casing formed of a strip of sheet material, the major portion of the strip being folded to form front and back cover panels; one end portion of said strip having a first fold forming a first substantially upstanding U-shaped fold into which a base portion of matches can be securably seated and a second fold extending back into the matchbook and forming a substantially inverted U-shaped fold; the opposite end portion of the strip having a single fold which extends outwardly of the matchbook and forms a further upstanding U-shaped fold which mates with said inverted U-shaped fold in interlocking engagement to prevent disengagement of the panels in the longitudinal direction, the panels being disengaged from each other by relative movement of the end portions in opposite lateral directions.

2. A matchbook folder with safety interlock, comprising: a casing formed of a strip of sheet material, the major portion of the strip being folded on form front and back cover panels, one end portion of said strip being doubly folded in on itself, the opposite end portion of the strip having a single fold which mates with the double-folded end portion in interlocking engagement to prevent disengagement of the panels in the longitudinal direction, the panels being disengaged from each other by relative movement of the end portions in opposite lateral directions, wherein said single- and double-folded portions have complementary bevelled faces to facilitate engagement and disengagement of said panels.

3. The matchbook folder with safety interlock according to claim 2, wherein: said one end portion of said strip has a first fold forming a first substantially upstanding U-shaped fold into which a base portion of matches can be securably seated and a second fold forming a substantially inverted U-shaped fold; and said single fold of said opposite end portion of said strip forms a further upstanding U-shaped fold which mates with said inverted U-shaped fold in interlocking engagement.

4. The matchbook folder with safety interlock according to claim 3, wherein said second fold of said one end portion of said strip extends back into the matchbook and forms said substantially inverted U-shaped fold and said further upstanding U-shaped fold extends outwardly of the matchbook.

* * * * *